US007021965B1

(12) United States Patent
Montena et al.

(10) Patent No.: US 7,021,965 B1
(45) Date of Patent: Apr. 4, 2006

(54) COAXIAL CABLE COMPRESSION CONNECTOR

(75) Inventors: Noah Montena, Syracuse, NY (US); Jeremy Amidon, Marcellus, NY (US)

(73) Assignee: John Mezza lingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/180,757

(22) Filed: Jul. 13, 2005

(51) Int. Cl.
*H01R 9/05* (2006.01)

(52) U.S. Cl. ..... 439/578; 439/585

(58) Field of Classification Search ..... 439/578, 439/584, 585
See application file for complete search history.

(56) References Cited

U.S. PATENT DOCUMENTS 6,558,194 B1 * 5/2003 Montena ..... 439/585
6,783,394 B1 * 8/2004 Holliday ..... 439/578
6,830,479 B1 * 12/2004 Holliday ..... 439/585
6,848,940 B1 2/2005 Montena

* cited by examiner

*Primary Examiner*—Tho D. Ta
(74) *Attorney, Agent, or Firm*—Pastel Law Firm; Christopher R. Pastel

(57) ABSTRACT

A compression connector for a coaxial cable includes a unitary plastic body with a post connected inside the plastic body and a nut connected to the post. An O-ring seals the connection between the nut and the plastic body. A compression ring is connected to an outside of the plastic body. A reinforcing shield is also connected to the outside of the plastic body. The reinforcing shield serves to reinforce the plastic body when the compression ring is moved to its compressed position, so that softer plastics can be used for the plastic body. The reinforcing shield and compression ring also protect the entire outside of the plastic body from the environment.

12 Claims, 4 Drawing Sheets

COAXIAL CABLE COMPRESSION CONNECTOR

FIELD OF THE INVENTION

This invention relates generally to the field of coaxial cable connectors, and more particularly to a compression connector with a unitary plastic body having an exterior reinforcing shield.

BACKGROUND OF THE INVENTION

Coaxial cable is a typical transmission medium used in communications networks, such as a CATV network. The cables which make up the transmission portion of the network are typically of the "hard-line" type, while those used to distribute the signals into residences and businesses are typically "drop" connectors. The principal difference between hard-line and drop cables, apart from the size of the cables, is that hard-line cables include a rigid or semi-rigid outer conductor, typically covered with a weather protective jacket, that effectively prevents radiation leakage and protects the inner conductor and dielectric, while drop connectors include a relatively flexible outer conductor, typically braided, that permits their bending around obstacles between the transition or junction box and the location of the device to which the signal is being carried, i.e., a television, computer, and the like, but that is not as effective at preventing radiation leakage. Hard-line conductors, by contrast, generally span considerable distances along relatively straight paths, thereby virtually eliminating the need for a cable's flexibility. Due to the differences in size, material composition, and performance characteristics of hard-line and drop connectors, there are different technical considerations involved in the design of the connectors used with these types of cables.

In constructing and maintaining a network, such as a CATV network, the transmission cables are often interconnected to electrical equipment that conditions the signal being transmitted. The electrical equipment is typically housed in a box that may be located outside on a pole, or the like, or underground that is accessible through a cover. In either event, the boxes have standard ports to which the transmission cables may be connected. In order to maintain the electrical integrity of the signal, it is critical that the transmission cable be securely interconnected to the port without disrupting the ground connection of the cable. This requires a skilled technician to effect the interconnection.

A type of connector usable on cables is the compression type connector, such as is disclosed in U.S. Pat. No. 6,331,123. Compression connectors utilize a compression member that is axially slidable with relation to the connector body for radially displacing connecting and sealing members into engagement with the cable's outer conductor. A compression tool that slides the compression body into the connector is used by the technician to effect the connection, and due to the physical constraints of the compression member and connector body, it is impossible for the technician to use too much force to effect the interconnection. Thus, compression connectors eliminate the assembly drawbacks associated with threaded, and to some degree, crimp type connectors.

SUMMARY OF THE INVENTION

Briefly stated, a compression connector for a coaxial cable includes a unitary plastic body with a post connected inside the plastic body and a nut connected to the post. An O-ring seals the connection between the nut and the plastic body. A compression ring is connected to an outside of the plastic body. A reinforcing shield is also connected to the outside of the plastic body. The reinforcing shield serves to reinforce the plastic body when the compression ring is moved to its compressed position, so that softer plastics can be used for the plastic body. The reinforcing shield and compression ring also protect the entire outside of the plastic body from the environment.

According to an embodiment of the invention, a compression connector for a coaxial cable includes a unitary plastic body; a post connected inside the plastic body; a nut connected to the post; a compression ring connected to an outside of the plastic body; and a reinforcing shield connected to an outside of the plastic body, wherein the reinforcing shield and compression ring protect the entire outside of the plastic body from the environment.

According to an embodiment of the invention, a method for making a compression connector includes the steps of (a) providing a unitary plastic body; (b) connecting a post inside the plastic body; (c) connecting a nut to the post; (d) sealing a connection between the nut and the plastic body; (e) connecting a reinforcing shield to an outside of the plastic body, and (f) connecting a compression ring to an outside of the plastic body, and wherein the reinforcing shield and compression ring protect the entire outside of the plastic body from the environment.

According to an embodiment of the invention, a compression connector includes a unitary plastic body; means for connecting a post inside the plastic body; means for connecting a nut to the post; means for sealing a connection between the nut and the plastic body; means for connecting a reinforcing shield to an outside of the plastic body, and means for connecting a compression ring to an outside of the plastic body; and wherein the reinforcing shield and compression ring protect the entire outside of the plastic body from the environment.

DETAILED DESCRIPTION OF THE PREFERRED EMBODIMENT

Figure 1:
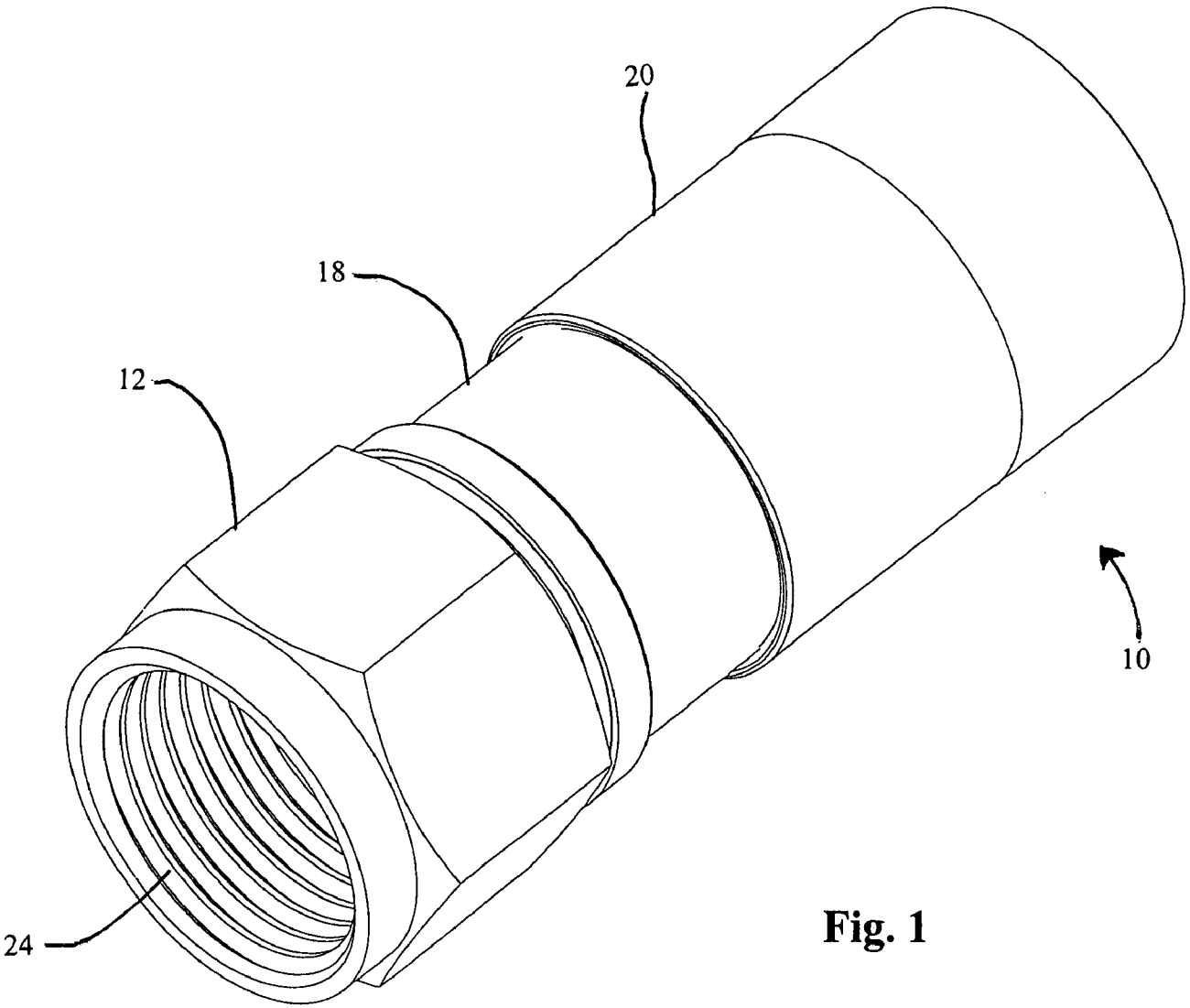
FIG. 1 shows a perspective view of a compression connector according to an embodiment of the invention.
Figure 2:
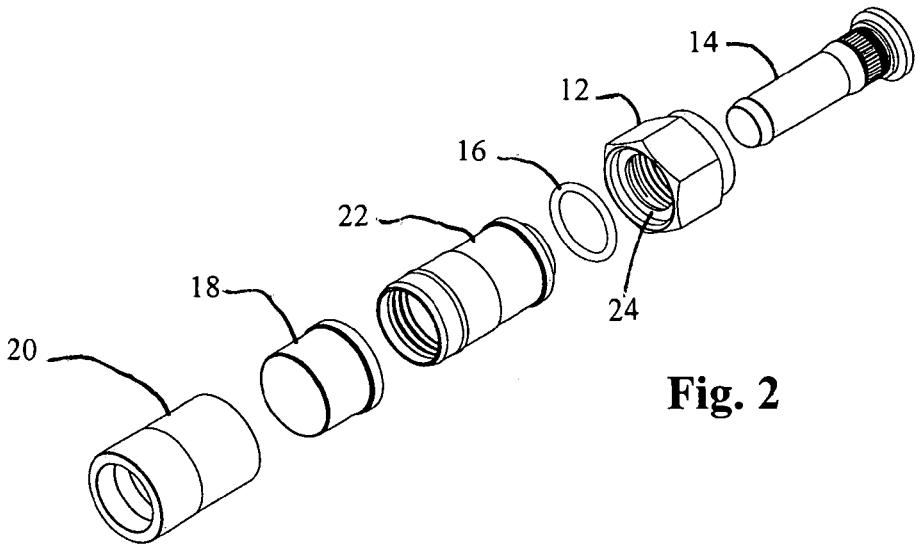
FIG. 2 shows an exploded view of the components of the compression connector of FIG. 1.
Figure 3:
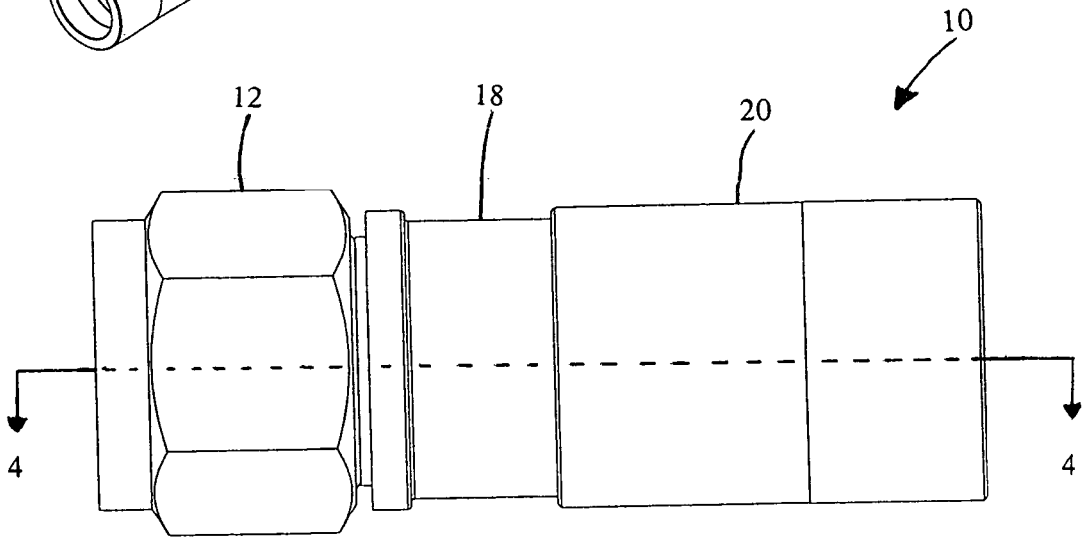
FIG. 3 shows a front elevation view of the compression connector of FIG. 1.

Referring to FIGS. 1–2, a coaxial cable compression connector 10 according to an embodiment of the invention is shown. A plastic body 22 is partly covered by a reinforcing shield 18 and partly covered by a compression ring 20. Compression ring 20 is preferably of metal but optionally is of plastic. A post 14 is disposed inside plastic body 22. A nut 12, preferably of metal for its conductive properties but optionally of plastic or composite material, is threaded with a thread 24 to permit connecting connector 10 to an equipment port or other device. An O-ring 16 preferably prevents moisture from entering connector 10 from the interface between nut 12, post 14, and plastic body 22.

Referring to FIGS. 3–8, additional details of connector 10 are shown. Shield 18 is held in place by shoulders 36 and 42 of plastic body 22. Plastic body 22 preferably includes a plurality of serrations 26, which, in conjunction with barbed tip 28 of post 14, provide a tight fit of the cable (not shown) and help to prevent moisture from entering connector 10 along the surface of the cable. After the end of the cable is prepared for installation, as is known by those skilled in the art of cable installation, the prepared cable end is inserted into end 40 of connector 10. Post 14 fits between the insulator core of the cable and the braided layer. Because plastic body 22 is of plastic, post 14 is preferably of a conductive material to form part of the electrical ground path from the cable braid to nut 12.

Because plastic body 22 is of plastic, it is susceptible to environmental damage from ultraviolet rays. The plastic is also susceptible to deformation from the forces imparted by compression ring 20 during cable installation, thus limiting the type of plastic used. Shield 18 is preferably metal but could be durable plastic or a composite material. Shield 18 protects plastic body 22 from the environment and also protects plastic body 22 from deformation resulting from compression ring 20, thus opening up a whole range of available plastic materials for use in making plastic body 22.

Shield 18 preferably includes a beveled edge 30 (FIG. 6) to prevent compression ring 20 from knocking shield 18 out of position while compression ring 20 is moved into position. Beveled edge 30 is preferably angled about 15 degrees from the horizontal. Plastic body 22 includes a beveled edge 38 to assist compression ring 20 in moving over plastic body 22 during assembly. Beveled edge 38 is preferably angled about 15 degrees from the horizontal. During assembly, compression ring 20 is moved over plastic body 22 until a beveled groove 34 in compression ring 20 snaps over a beveled stop 32 on plastic body 22.

Connector 10 is preferably assembled as follows. Shield 18 is snapped over plastic body 22. Then post 14 is inserted into nut 12. O-ring 16 is placed onto plastic body 22. Then the post 14 and nut 12 combination is moved into plastic body 22 until it engages with plastic body 22. Compression ring 20 is moved onto plastic body 22 until beveled groove 34 in compression ring 20 snaps over beveled stop 32. During cable installation, the prepared cable end is inserted through compression ring 20 into plastic body 22 so that the end of post 14 is engaged between the cable braid and the cable insulated core. Compression ring 20 is then forced onto plastic body 22 and part of metal shield 18 using a conventional compression tool until compression ring 20 is held tightly in place by the friction fit between the cable, compression ring 20, shield 18, plastic body 22, and post 14. The installation of connector 10 onto the cable is then complete.

Figure 4A:
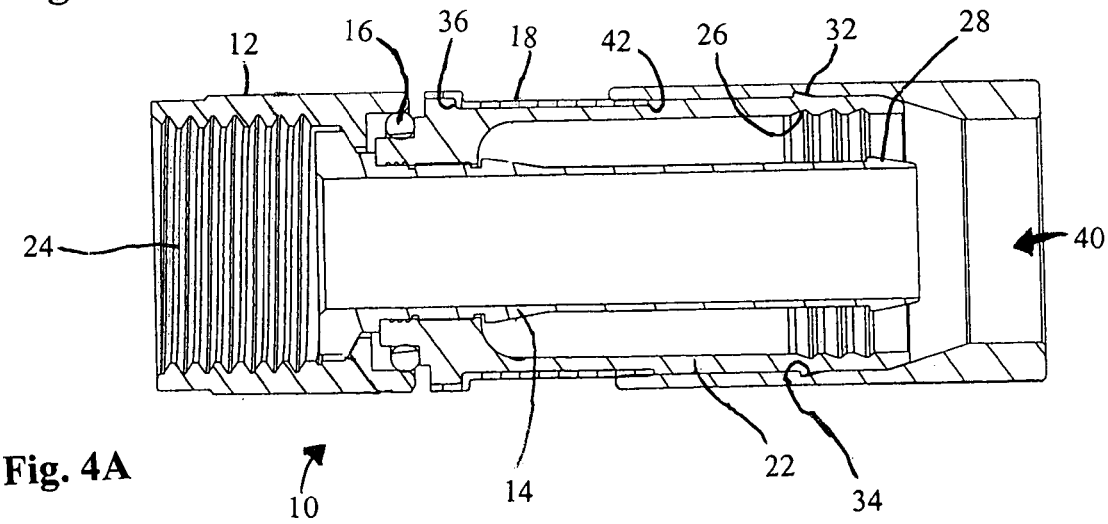
FIG. 4A shows a cross section of an embodiment of the compression connector of the present invention taken along the lines 4—4 in FIG. 3.
Figure 4B:
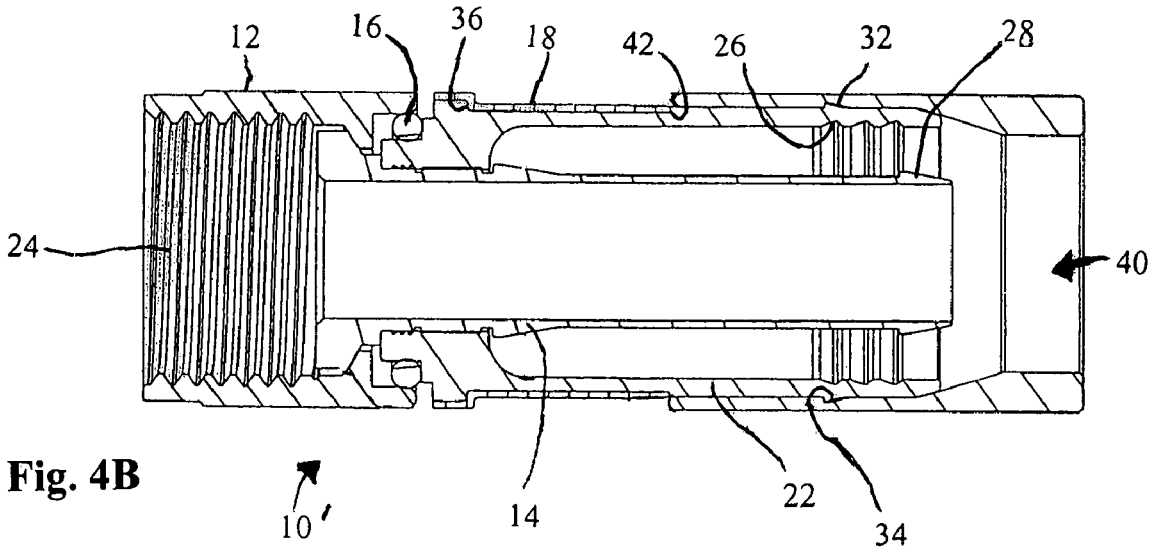
FIG. 4B shows a cross section of an embodiment of the compression connector of the present invention taken along the lines 4—4 in FIG. 3.
Figure 5:
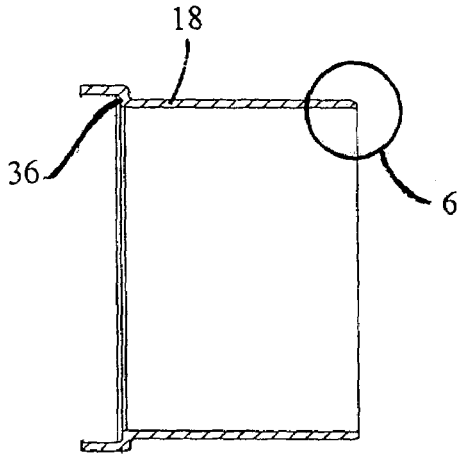
FIG. 5 shows a cross-sectional view of a metal shield according to an embodiment of the present invention.
Figure 6:
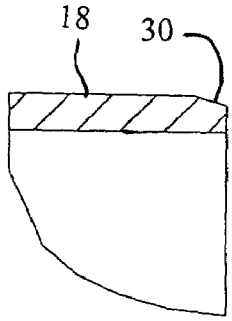
FIG. 6 shows an enlarged view of section 6 of FIG. 5.
Figure 7:
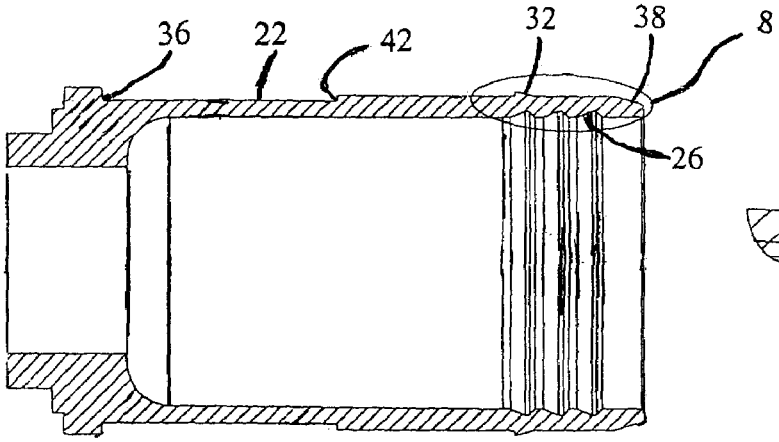
FIG. 7 shows a cross-sectional view of a unitary plastic body according to an embodiment of the present invention.
Figure 8:
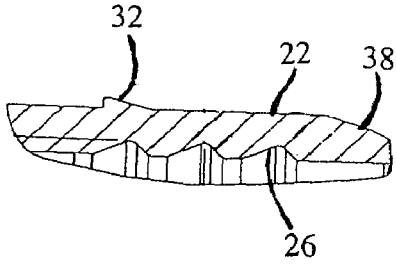
FIG. 8 shows an enlarged view of section 8 of FIG. 7.

In the embodiment of FIG. 4A, compression ring 20 overlaps shield 18 in the uncompressed position, while in the embodiment of FIG. 4B, compression ring 20 of compression connector 10' does not overlap shield 18 when in the uncompressed position. When in the compressed position, compression ring 20 overlaps shield 18 whether using the embodiment of FIG. 4A or the embodiment of FIG. 4B.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A compression connector for a coaxial cable, comprising:

a unitary plastic body;

a post connected inside the plastic body;

a nut connected to the post;

a compression ring connected to an outside of the plastic body; and a reinforcing shield, separate from the nut, connected to an outside of the plastic body, and wherein the reinforcing shield and compression ring protect the entire outside of the plastic body from the environment when the compression connector is in both a compressed position and an uncompressed position.

2. A compression connector according to claim 1, wherein the plastic body includes two shoulders which hold the reinforcing shield in place.

3. A compression connector according to claim 2, wherein the reinforcing shield includes a beveled edge on one end.

4. A compression connector according to claim 3, wherein the plastic body includes a beveled stop which fits into a corresponding beveled groove in the compression ring.

5. A method for making a compression connector, comprising the steps of:

providing a unitary plastic body;

connecting a post inside the plastic body;

connecting a nut to the post;

sealing a connection between the nut and the plastic body;

connecting a reinforcing shield, separate from the nuts to an outside of the plastic body, and connecting a compression ring to an outside of the plastic body;

wherein the reinforcing shield and compression ring protect the entire outside of the plastic body from the environment when the compression connector is in both a compressed position and an uncompressed position.

6. A method according to claim 5, wherein the plastic body includes two shoulders which hold the reinforcing shield in place.

7. A method according to claim 6, wherein the reinforcing shield includes a beveled edge on one end.

8. A method according to claim 7, wherein the plastic body includes a beveled stop which fits into a corresponding beveled groove in the compression ring.

9. A compression connector, comprising:

a unitary plastic body;

means for connecting a post inside the plastic body;

means for connecting a nut to the post;

means for sealing a connection between the nut and the plastic body;

means for connecting a reinforcing shield to an outside of the plastic body, wherein the reinforcing shield is separate from the nut; and means for connecting a compression ring to an outside of the plastic body;

wherein the reinforcing shield and compression ring protect the entire outside of the plastic body from the environment, when the compression connector is in both a compressed position and an uncompressed position.

10. A compression connector according to claim 9, wherein the means for connecting the reinforcing shield to the plastic body includes two shoulders which hold the reinforcing shield in place.

11. A compression connector according to claim 10, wherein the metal reinforcing includes a beveled edge on one end.

12. A compression connector according to claim 11, wherein the plastic body includes a beveled stop which fits into a corresponding beveled groove in the compression ring.

* * * * *

UNITED STATES PATENT AND TRADEMARK OFFICE

CERTIFICATE OF CORRECTION

PATENT NO. : 7,021,965 B1
APPLICATION NO. : 11/180757
DATED : April 4, 2006
INVENTOR(S) : Montena et al.

It is certified that error appears in the above-identified patent and that said Letters Patent is hereby corrected as shown below:

Column 4,
Line 39, delete “nuts” and replace with -- nut, --.

Signed and Sealed this

Fourth Day of July, 2006

JON W. DUDAS
*Director of the United States Patent and Trademark Office*